United States Patent [19]

Pischinger et al.

[11] Patent Number: 4,709,547

[45] Date of Patent: Dec. 1, 1987

[54] PROCESS FOR THE REGENERATION OF ENGINE EMISSION PARTICULATES DEPOSITED IN A PARTICULATE TRAP

[75] Inventors: Franz Pischinger, Aachen; Gerhard Lepperhoff, Eschweiler; Georg Hüthwohl, Aachen, all of Fed. Rep. of Germany

[73] Assignee: FEV Motorentechnik GmbH & Co. KG, Aachen, Fed. Rep. of Germany

[21] Appl. No.: 16,003

[22] Filed: Feb. 18, 1987

[30] Foreign Application Priority Data

Feb. 19, 1986 [DE] Fed. Rep. of Germany ..... 3605255

[51] Int. Cl.[4] ..... F01N 3/02

[52] U.S. Cl. ..... 60/274; 60/285; 60/302; 60/311

[58] Field of Search ..... 60/274, 285, 302, 311

[56] References Cited

U.S. PATENT DOCUMENTS

| | | | |
|---|---|---|---|
| 3,786,635 | 1/1974 | Kates | 60/302 |
| 4,452,040 | 6/1984 | Kobashi | 60/274 |

FOREIGN PATENT DOCUMENTS

| | | | |
|---|---|---|---|
| 132416 | 10/1981 | Japan | 60/311 |
| 79024 | 5/1984 | Japan | 60/274 |
| 82515 | 5/1984 | Japan | 60/285 |

OTHER PUBLICATIONS

SAE Publication No. 861110, 1985, DDEC II, Advanced Electronic Diesel Control.

*Primary Examiner*—Douglas Hart

*Attorney, Agent, or Firm*—Watson, Cole, Grindle & Watson

[57] ABSTRACT

A process for the regeneration of engine emission particulates collected in particulate filter traps associated with each of the engine cylinders, or with groups of such cylinders, includes the selective elevation of the emission temperature of at least one of the cylinders or groups to the extent required for regeneration, by oxidation, of the filter trap or traps associated therewith, by supplying engine fuel to such cylinder or cylinders in a predtermined amount to produce the elevated emission temperature, and supplying the remaining of the cylinders with amounts of engine fuel less than such predetermined amount as required to sustain the given engine power output.

13 Claims, 3 Drawing Figures

PROCESS FOR THE REGENERATION OF ENGINE EMISSION PARTICULATES DEPOSITED IN A PARTICULATE TRAP

BACKGROUND OF THE INVENTION

This invention relates to a process for the regeneration, by oxidation, of internal combustion engine emission particulates collected in filter traps associated with each of the engine cylinders or with groups of the engine cylinders.

Particulate emission control systems have been developed for diesel engines to reduce exhaust gas pollutants of internal combustion engines as much as possible. These systems include particulate filter traps which collect solid particulates, such as carbon. The known particulate filter traps, however, are not entirely free of problems since the particulates deposited in the filter may cause increased flow resistance in the engine exhaust system which in turn increases the exhaust back pressure on the engine. As the collected particulate mass increase, it leads to a higher fuel consumption, as a function of engine load and rpm, and may result in engine stall in extreme cases. It therefore becomes necessary to continuously or intermittently remove the deposited particulates in the filter trap, generally by oxidation.

Ceramic particulate filter traps of honeycomb structure, steel wool filter traps and ceramic foam filter traps, with or without catalytic coating, are proven effective particulate filter systems.

Oxidation of particulates collected in the filter trap commences at temperatures above 500° to 550° C. The required temperature for oxidation can be lowered to 400° to 450° C. by using catalytic coating. Diesel engines reach such high temperatures only at very high loads and speed ranges. Adequately frequent regeneration during the engine operating mode is therefore not assured. To raise the engine exhaust to the temperature required for oxidation, it has been known to throttle the air intake, throttle the exhaust gases or shift the fuel supply timing.

However, these approaches do not achieve high exhaust gas temperatures required for filter trap regeneration in the engine's lower load ranges. Besides, these known measures effect considerably higher engine fuel consumption.

SUMMARY OF THE INVENTION

The present invention addresses the problem of achieving filter trap regeneration over the entire operational range of the vehicle engine without causing significant increase in fuel consumption.

In accordance with the invention, a process has been developed for the regeneration of engine emission particulates collected in filter traps associated with each of the engine cylinders or with a group of such cylinders, by selectively elevating the emission temperature, in at least one of the cylinders, or in a group of cylinders, to the extent required for regneration, by oxidation, of the filter trap or traps associated therewith, by supplying engine fuel, or fuel-air mixture, to such cylinder or cylinders in a predetermined amount to produce the elevated emission temperature. The remaining cylinders or groups of cylinders are supplied with engine fuel, or a fuel-air mixture, in amounts less than the predetermined amount as required to sustain a given engine power output requirement.

Regeneration of separate filter traps is carried out by injection of the full-load engine fuel supply, or of an adequate supply of engine fuel to produce the exhaust gas temperature required for regeneration in the engine cylinders with which the filter traps are associated, and by regulating the partial engine load volume for the other cylinders corresponding to the engine output requirements. The regeneration of the individual filter traps can be initiated in a timely manner as a function of engine load and rpm or as a function of the exhaust gas temperature.

The distribution of the fuel volume injected in the individual cylinders can be effected electronically by adjusting the respective control piston of a block-injection pump, or can be effected by a regulated pump-nozzle system. Control of the fuel injection quantity is also made possible by adjusting a by-pass valve in the fuel injection line while maintaining a constant supply rate for the fuel injection pump.

Other objects, advantages and novel features of the invention will become more apparent from the following detailed description of the invention when taken in conjunction with the accompanying drawings.

DETAILED DESCRIPTION OF THE INVENTION

Figure 1:
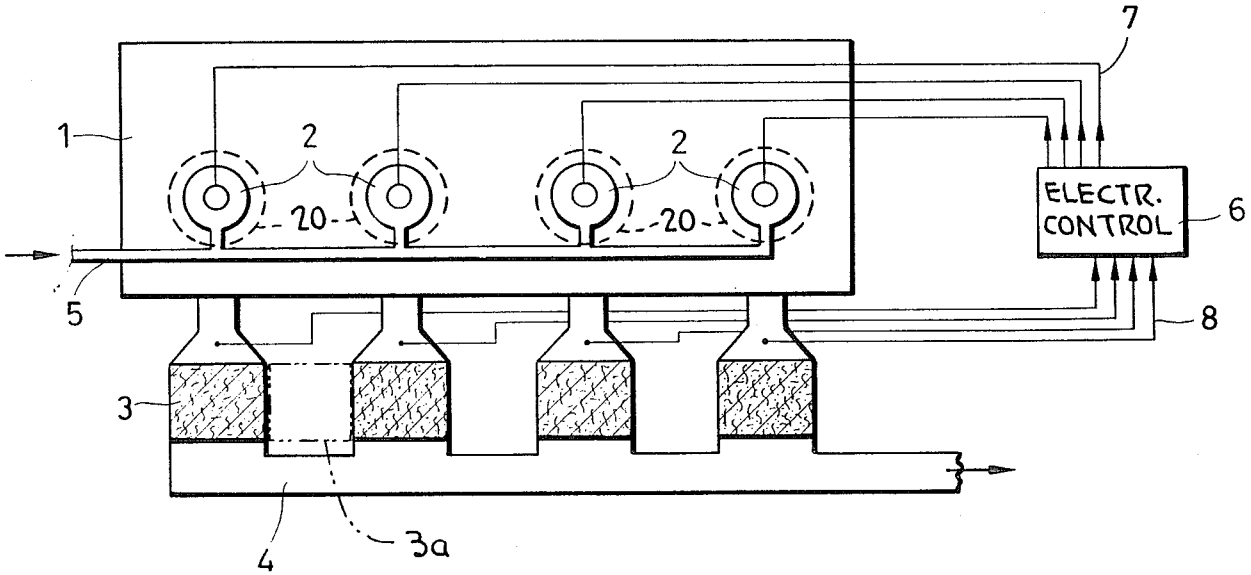
FIG. 1 is a schematic illustration of an internal combustion engine having an engine emission particulate filter trap system for carrying out the process according to the invention.

Turning now to the drawings wherein like reference characters refer to like and corresponding parts throughout the several views, diesel engine 1 of FIG. 1 is equipped with pump-nozzle elements 2 respectively associated with engine cylinders 20, an engine fuel supply line 5 communicating with elements 2, an engine exhaust system 4, and particulate filter traps 3 as part of the engine exhaust system and respectively associated with the engine cylinders. Alternatively, a particulate filter trap 3*a*, shown in phantom outline, may be associated with a pair (as shown) of engine cylinders, or with a group of more than two cylinders, or filter traps 3*a* may be associated with respective pairs of cylinders, or each with more than two cylinders depending on the number of engine cylinders, without departing from the invention.

An electronic control unit 6, of known type forming no part of the invention, is electrically connected to the respective pump-nozzle elements 2 via control lines 7, and is electrically connected to each of the particulate filter traps via sensor lines 8. Depending on the required engine output and engine speed, the timing and duration of the engine fuel injection is adjusted by electronic control unit 6 via control lines 7. To achieve the high exhaust gas temperature required for regeneration of the individual particulate filter traps 3, unit 6 is adjusted in some normal manner such that the fuel injection timing duration for cylinder "one", for example, produces exhaust gas temperatures exceeding 600° C. from this cylinder. Such high temperatures will ignite the soot collected in the associated particulate filter trap and will cause it to burn off. Given the excess fuel quantity in cylinder "one", at constant engine load and speed, it becomes necessary to adjust for allocation of lesser amounts of engine fuel to cylinders "two", "three" and "four". This allocation and control is carried out by electronic control unit 6.

After regeneration at cylinder "one", regeneration of the particulate filter traps associated with cylinders "two", "three" and "four" takes place as a function of time or as a function of the load placed on the engine. Regeneration can be initiated as a function of time or by a signal which indicates the quantity of carbon deposited within a given particulate filter trap. The exhaust gas back pressure in front of the respective particulate filter trap, or a valve indicating the thickness of the carbon layer built up within the filter trap, can be employed as control parameters via sensor lines 8.

Adjustment of the fuel injection volume and injection timing to initiate carbon oxidation can be effected during the entirety of the regeneration of the respective filter trap, or such may be carried out intermittently to produce ignition of the carbon deposits in the filter trap. Thus, the carbon deposit may be ignited by a temporary increase of the exhaust gas temperature by intermittant adjustment of the full load volume. And, subsequently, because of exothermal combustion of the carbon deposit, the temperature level within the carbon layer of the filter trap is sufficiently high to permit self-contained combustion of the carbon to take place even when the engine cylinder operates under only partial load. Moreover, this process can be carried out while alternating between two or more separate cylinders or groups of cylinders.

Rather than providing separate particulate filter traps for each engine cylinder with separate control of fuel injection into the respective cylinders, groups of cylinders in a multi-cylinder engine, can be combined together as a unit as regards the fuel injection and exhaust control.

And, rather than employing pump-nozzle elements with electronic control as aforedescribed, a block injection pump with adjustment of the individual pistons, controlled electromagnetically or hydraulically, can be utilized. Moreover, the specific cylinder regeneration can be carried out via by-pass controlled injection timing. With such an approach, the fuel injection pump controls the timing of the fuel injection and always delivers a constant volume of fuel. The required amount to be injected, as a function of engine load or regeneration requirements, is effected via a by-pass valve cycle.

Figure 3:
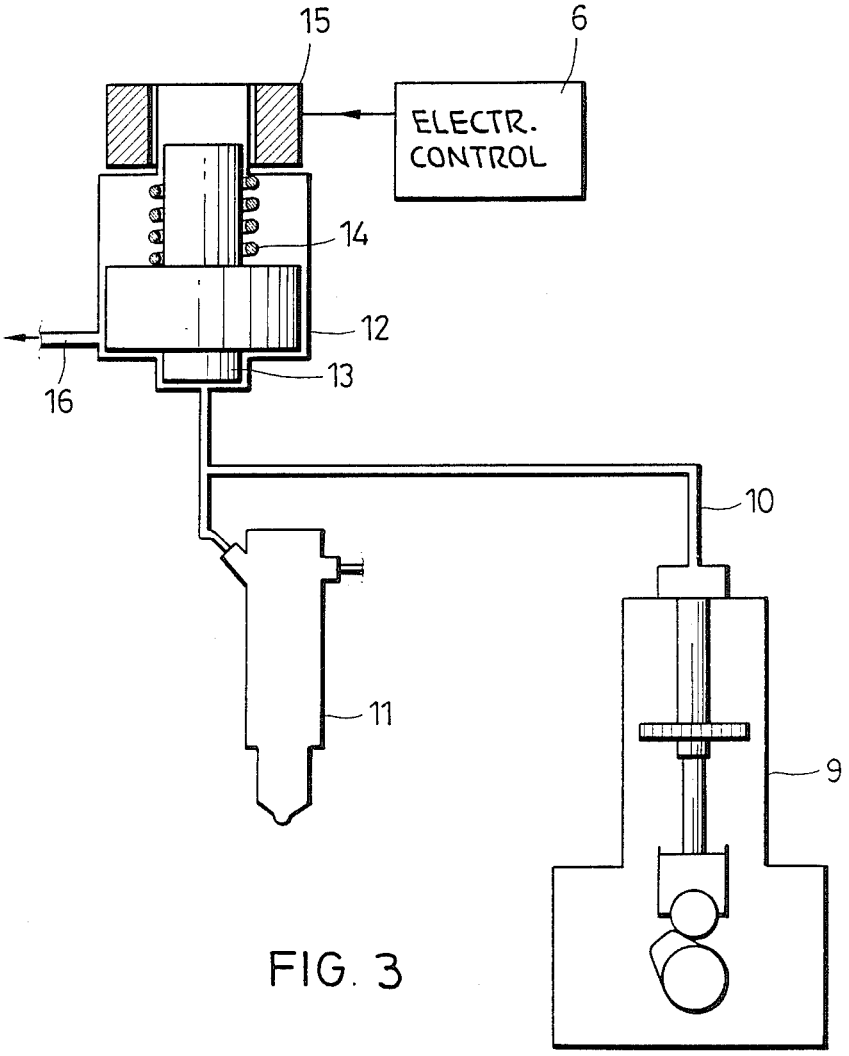
FIG. 3 is a detailed, schematic illustration of an engine emission particulate filter trap system for carrying out the process according to the invention.

Such a technique is illustrated in FIG. 3 in which an engine fuel pump 9 is arranged to deliver a constant flow of fuel via a pressure line 10. The volume of fuel injected into the combustion chamber of the engine cylinder by a nozzle 11, associated with each of the engine cylinders although only one of such nozzles is shown, is controlled by a by-pass valve 12. Excess fuel is returned to the supply tank (not shown) via a fuel return line 16.

In order to terminate fuel injection in a partial engine load range, i.e. less than full engine load, a control piston 13 is lifted against the bias of a spring 14 by a lifting electromagnet 15 which is controlled by electronic control unit 6. A by-pass valve 12 is associated with each nozzle 11 of a multi-cylinder engine. Piston 13 is subjected to the fuel injection pressure in line 10 and, after being lifted slightly away from the bottom end of the housing of the valve 12, the enlarged surface of piston 13 opens valve 12 and suddenly permits fuel to be diverted to return line 16 to thereby close injection valve 11. Because of loss of pressure in fuel injection line 10 and because the electromagnet is switched off, spring 14 returns piston 13 back to its at rest position shown in FIG. 3.

Figure 2:
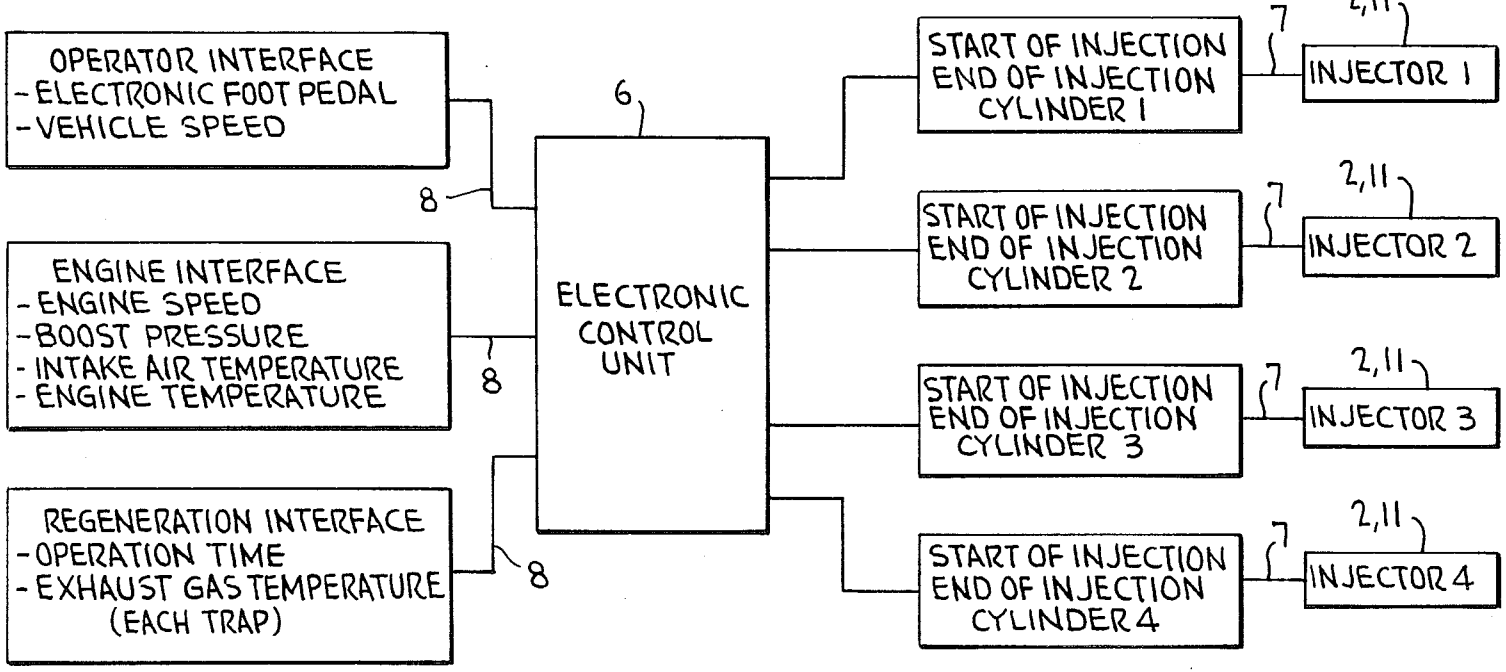
FIG. 2 is a schematic function diagram of the electronic control unit employed for carrying out the invention.

Control unit 6 may be of a type described in SAE publication No. 861110, 1985, entitled "DDEC II, Advanced Electronic Diesel Control." This unit, functionally diagrammed in FIG. 2, controls fuel injection timing and quantity via electronic unit injectors 2 or 11. This two-box system includes a cab-mounted module containing the digital electronics and an engine-mounted, fuel-cooled module with the analog injector driver components. Sensors 8, monitoring critical operator, engine and regeneration parameters, provide signals to unit 6 for the microprocessor calculations.

The regeneration process of the invention offers considerable advantages over secondary energy regeneration systems, unregulated regeneration systems, or regeneration systems with other engine-related functions. Depending on the specific application, the following specific advantages are attained by the present process.

Regeneration of the particulate filter trap or traps can be carried out over substantially the entire load range of the operating engine.

The regeneration parameters for any of the filter traps, such as exhaust temperature and oxygen content, can be adjusted during regneration as a function of engine rpm in such a manner as to assure an operationally safe, controlled regneration of a filter trap even when the loading volume is low.

During transition of the vehicle engine to the thrust phase (zero load), to idling or when the engine is being turned off, regeneration can be controllably terminated by slow reduction of the load at the regeneration cylinder.

Since the filter traps can be regenerated frequently, the carbon collection capacity requirements of the filter are relatively low such that less bulky and voluminous filter traps can be utilized.

The degree of effective combustion of the diesel engine is constant in the range of intermediate loads and only drops at very high or very low values. Consequently, any increase in fuel consumption during regeneration is not expected.

A further advantage in improving and expanding the approach taken by the invention is that when additives are mixed into the fuel to accelerate soot ignition in the filter trap or traps, the concentration of additives in the regenerating filter will be increased.

It is manifest that many other modifications and variations of the invention are made possible in the light of the above teachings. For example, it may be particularly advantageous if the exhaust gas temperature required for regeneration of the individual filter traps, or groups of filter traps, for diesel engines occurs via delayed adjustment of the fuel injection at the respective individual cylinder or at the respective group or groups of cylinders. It is therefore to be understood that within the scope of the appended claims the invention may be practiced otherwise than as specifically described.

What is claimed is:

1. In an internal combustion engine having a plurality of engine cylinders operating at a given power output, a process for the regeneration of engine emission particulates collected in particulate filter traps respectively associated with each of the engine cylinders, comprising the steps of selectively elevating the emission temperature of at least one of the cylinders to the extent required for regeneration, by oxidation, of the filter trap associated therewith, by supplying engine fuel to said at least one of said cylinders in a predetermined amount to produce the elevated emission temperature, and supply the remaining of said cylinders with amounts of engine fuel less than said predetermined amount as required to sustain the given engine power output.

2. In an internal combustion engine having more than two engine cylinders operating at a given power output, a process for the regeneration of engine emission particulates collected in particulate filter traps associated with said cylinders, at least one of said traps being associated with at least a pair of said cylinders, comprising the steps of selectively elevating the emission temperature of said pair of cylinders to the extent required for regeneration, by oxidation, of said one filter trap, by supplying said pair of cylinders in a predetermined amount to produce the elevated emission temperature, and supplying the remaining of said cylinders with an amount of engine fuel less than said predetermined amount as required to sustain the given engine power output.

3. The process according to claim 1, wherein the engine has more than two of the engine cylinders, the emission temperature of at least a pair of the cylinders being selectively elevated to the extent required for regeneration of the filter traps associated therewith, by supplying engine fuel to said pair of cylinders in the predetermined amount to effect the elevated temperature.

4. The process according to claims 1 or 2, wherein the engine has at least four of the engine cylinders, a plurality of said remaining cylinders being supplied with a given amount of engine fuel less than said predetermined amount as required to sustain the given engine power output.

5. The process according to claim 1 or 2, wherein the engine fuel supplied to effect the elevated emission temperature is at a level to achieve full load engine operation.

6. The process according to claims 1 or 2, wherein the supplying steps are carried out by injecting unequal amounts of the engine fuel by pumping a constant volume of the fuel through separate nozzles associated with the cylinders, via separate control pistons associated with the nozzles.

7. The process according to claims 1 or 2, wherein separate pump-nozzle elements are associated with the cylinders, and the supplying steps are carried out by injecting unequal amounts of the engine fuel via the separate elements, and electronically adjusting the timing and duration of the injections.

8. The process according to claim 6, wherein the control pistons are adjusted electronically for by-passing fuel through the pistons for injecting required amounts of fuel into the cylinders.

9. The process according to claims 1 or 2, wherein the step of elevating the emission temperature is carried out as a function of time.

10. The process according to claims 1 or 2, wherein the step of elevating the emission temperature is carried out as a function of engine emission back pressure.

11. The process according to claims 1 or 2, wherein the step of elevating the emission temperature is carried out as a function of the amount of emission particulates in the filter trap being regenerated.

12. The process according to claims 1 or 2, wherein the first mentioned supplying step is carried out intermittently.

13. The process according to claims 1 or 2, wherein the first mentioned supplying step is carried out alternately and intermittently.

* * * * *